US008125853B2

(12) United States Patent
Greubel et al.

(10) Patent No.: US 8,125,853 B2
(45) Date of Patent: Feb. 28, 2012

(54) WATCH BRACELET

(75) Inventors: Robert Greubel, Lignieres (CH); Stephen Forsey, Les Brenets (CH)

(73) Assignee: GFPI S.A., La Chaux-de-Fonds (CH)

( * ) Notice: Subject to any disclaimer, the term of this patent is extended or adjusted under 35 U.S.C. 154(b) by 414 days.

(21) Appl. No.: 12/528,350

(22) PCT Filed: Feb. 21, 2008

(86) PCT No.: PCT/EP2008/052115

§ 371 (c)(1),
(2), (4) Date: Aug. 24, 2009

(87) PCT Pub. No.: WO2008/101983

PCT Pub. Date: Aug. 28, 2008

(65) Prior Publication Data

US 2011/0005274 A1 Jan. 13, 2011

(30) Foreign Application Priority Data

Feb. 22, 2007 (CH) ..... 0298/07

(51) Int. Cl.
*G04B 47/00* (2006.01)
*A44C 5/14* (2006.01)

(52) U.S. Cl. ..... 368/10; 368/282; 24/265 WS; 224/165

(58) Field of Classification Search ..... 368/10, 368/278, 281, 282; 24/265 WS; 224/165
See application file for complete search history.

(56) References Cited

U.S. PATENT DOCUMENTS

| | | | | |
|---|---|---|---|---|
| 1,874,984 | A | 8/1932 | Hanskat | |
| 2,679,785 | A * | 6/1954 | Batt | 359/441 |
| 5,601,222 | A | 2/1997 | Haddad | |
| 5,883,860 | A * | 3/1999 | McKay | 368/10 |
| 6,950,374 | B2 * | 9/2005 | McKay | 368/10 |
| 2002/0092085 | A1 * | 7/2002 | Robertshaw | 2/311 |
| 2004/0151077 | A1 * | 8/2004 | McKay | 368/278 |

FOREIGN PATENT DOCUMENTS

| | | |
|---|---|---|
| CH | 682290 | 8/1993 |
| DE | 20106021 | 7/2001 |
| FR | 2599521 | 12/1987 |

OTHER PUBLICATIONS

International Search Report dated Jun. 3, 2008, in PCT application.

* cited by examiner

*Primary Examiner* — Vit Miska
(74) *Attorney, Agent, or Firm* — Young & Thompson

(57) ABSTRACT

A watch bracelet includes two straps (12, 14; 46, 48), designed to be fixed to a watch case (24, 44) at one of the ends thereof, characterized in being provided with a lentiform loop (18, 40, 58) fixed thereto.

7 Claims, 13 Drawing Sheets

WATCH BRACELET

TECHNICAL FIELD

The present invention relates to watch bracelets. They are generally made up of two strands each fixed by their ends on one hand to the case and on the other hand to a part of a clasp. The latter is arranged so as to allow opening and closing of the bracelet, enabling the placement, removal and maintenance of the watch on the wearer's wrist.

BACKGROUND OF THE INVENTION

The strands of the bracelet are made in a flexible material, such as leather or plastic, or in a hard material, for example metal or ceramic, in the form of links mounted hinged to each other.

The bracelet can also be made of two rigid arms in a circular arc, hingedly connected to the case.

The clasp can in particular be formed, secured to one of the strands, by a buckle and a tongue, which engages in holes comprised by the other strand. It can also be of the deploying type, comprising one or two pairs of hinged arms, kept closed by a locking member. The functional structure of these different types of bracelet and clasp are well known by one skilled in the art, which is why they will not be described in further detail as to their maintenance function.

The function of the bracelet is therefore generally to ensure maintenance of the watch on the arm of the wearer. Known, however, are bracelets on which plates are mounted bearing written information, for example a calendar. Also known are bracelets with links whereof at least one is hollow and is used to house objects with small dimensions, for example contact lenses.

Document CH 682'290 describes, for example, a bracelet provided with a housing in which an object such as a magnifying glass can be arranged. The magnifying glass is removable and can easily be moved away. Moreover, document FR 2,599,521 relates to a watch provided with a mirror mounted pivoting on the case and covering the display.

Document U.S. Pat. No. 5,601,222 concerns a wristwatch in which a magnifying glass is integrated to one of the strands of the bracelet. All leads one to think that this is a Fresnel-type magnifying glass, given its shape and dimensions. A magnifying glass of this type is generally made in plastic. In the described embodiment, the dimensions of the magnifying glass are certainly large, but the risk is great that the magnifying glass will deform and scratch, then no longer being able to perform its function.

In document U.S. Pat. No. 1,874,984, a magnifying glass is secured to a wristwatch case using a small chain. This small chain risks catching, making wearing the watch somewhat uncomfortable. Lastly, the German utility model DE 201'06'021 describes a watch provided with a magnifying glass mounted on the cap of the clasp or on the case. The magnifying glass arranged on the cap of the clasp seems to be made up of a cylinder whereof the diameter is smaller than the thickness, not able to ensure an observation function.

Very top-of-the-line watches sometimes comprise identification codes etched on the bottom of the case. These are very difficult to read, since they must be discreet in order to avoid effecting the esthetics of the product. The presence of a magnifying glass makes it possible to verify this information, but also to examine the fineness of the decorations with which the watch is provided in detail.

BRIEF DESCRIPTION OF THE INVENTION

One aim of the present invention is to offset the drawbacks cited above, while allowing the wearer of the watch to see objects or signs with small dimensions.

To this end, the watch bracelet comprises two strands designed to be secured each by one of its ends to a watch case and a clasp attached to the strands by their other end, the clasp being able to occupy an open position and a closed position. The bracelet is provided, according to the invention, with a magnifying glass of lenticular shape fixed thereto.

"Magnifying glass of lenticular shape" refers to a magnifying glass in the form of a lens, i.e. whereof the thickness at the center is substantially greater than that of the periphery. The ratio is at least equal to 2:1. The periphery can, of course, end with a beveled edge.

Advantageously, the bracelet also comprises a protection member arranged so as to cover the magnifying glass when the clasp is closed.

In a first variation, this clasp can comprise at least two arms hinged to each other using a hinge integral with one of the two ends of the two arms, and a body integral with the other end of the arm, the magnifying glass being mounted in this body.

In another variation, the magnifying glass is mounted in one of the strands of the bracelet, the other strand forming the protection member.

The strand on which the magnifying glass is mounted can also be rigid and the magnifying glass mounted hingedly on this strand. Advantageously, the magnifying glass is mounted on the strand via a spherical structure allowing orientation of the magnifying glass by rotation and tilting.

In order to avoid scratching of the magnifying glass, it is advantageously made in sapphire.

In another variation, the clasp comprises a median arm and two end arms, the median arm being hingedly connected to the two end arms. The magnifying glass is fixed to the median arm and the end arms comprise, in their portion adjacent to said magnifying glass when the bracelet is closed, a flexible film forming a protection member.

The present invention also concerns a watch provided with a bracelet as defined above. This watch also comprises a case. The case and the clasp comprise male members for one, female members for the other arranged to be engaged in each other.

BRIEF DESCRIPTION OF THE DRAWINGS

The invention will be better understood upon reading the description which follows, provided as an example and done in reference to the drawings in which.

DETAILED DESCRIPTION OF THE INVENTION

Figure 1:
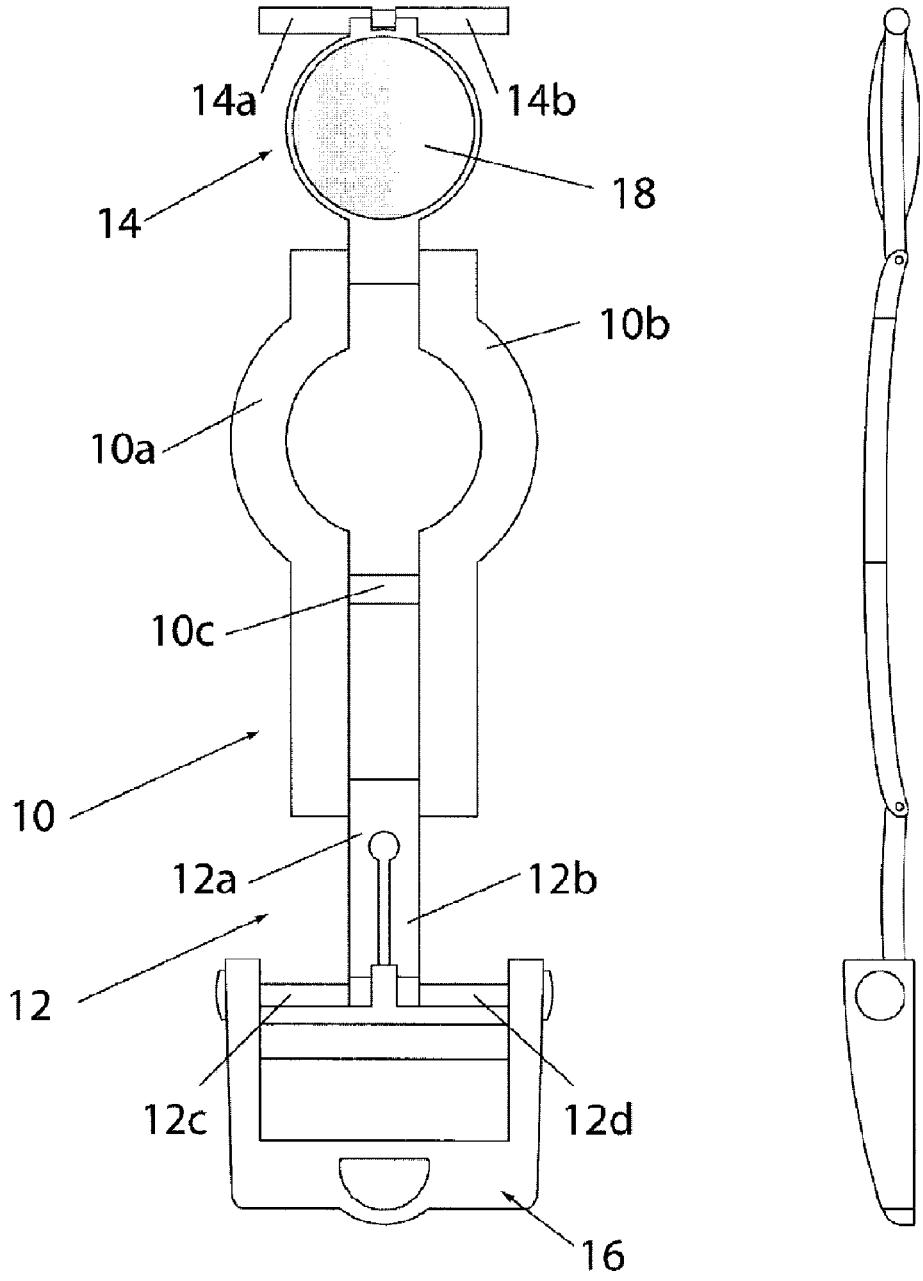
FIGS. 1 to 3 and 3*a* illustrate, diagrammatically, four embodiments of the invention.

FIG. 1 illustrates a clasp for a watch bracelet of the deploying buckle type and designed to equip a bracelet provided with flexible strands, for example in leather. This clasp comprises a body 10, two arms 12 and 14 mounted hingedly each at one of the ends of the body 10 and a buckle 16 mounted hingedly on the arm 12.

The body 10 comprises two bars 10*a* and 10*b* connected to each other via a rod 10*c* and by arbors not visible in the drawing and which ensure the pivoting of the arms 12 and 14 on the body 10.

The arm 12 presents a structure of the tuning fork type, with two bars 12*a* and 12*b* free at one end and connected to each other in the part of the arm hinged on the body 10. The bars 10*a* and 10*b*, 12*a* and 12*b* are arranged so as to allow notch interlocking of the arm 12 in the body 10. The arm 12 comprises, at its end opposite its hinge, two fingers 12*c* and 12*d* oriented perpendicularly to the arms 12*a* and 12*b* designed to receive a buckle 16 in which one of the strands of the bracelet is fixed.

The space between the bars 10*a* and 10*b* is defined such that the bars 12*a* and 12*b* and the arm 14 can be housed there.

The arm 14 has, in its median portion, a cylindrical opening in which is arranged a magnifying glass 18, fixed, for example, by sticking. The end of the arm 14 opposite its articulation with the body 10 is provided with two fingers 14*a* and 14*b* arranged laterally and aligned with each other, designed to receive the end of the second strand of the bracelet opposite the case.

When the clasp is open, as shown in FIG. 1, the magnifying glass 18 can be arranged above the back of the watch, in order to look at its components, if the bottom is transparent, for information appearing on the bottom of the case, or also an object arranged on this bottom, for example a stamp, a medal, a jewel, etc.

When a watch equipped with a clasp of this type is put on the arm, the wearer begins by folding the arm 14 down such that it is engaged between the two bars 10*a* and 10*b* of the body 10, then the arm 12 is folded, the bars 12*a* and 12*b* clipping into the body 10, while the end of the arm 12 and the buckle 16 covers the arm 14 and keeps it in place. In this position, the strand of the bracelet engaged in the buckle 16 covers the magnifying glass 18 and protects it, thereby forming a protection member.

Figure 2:
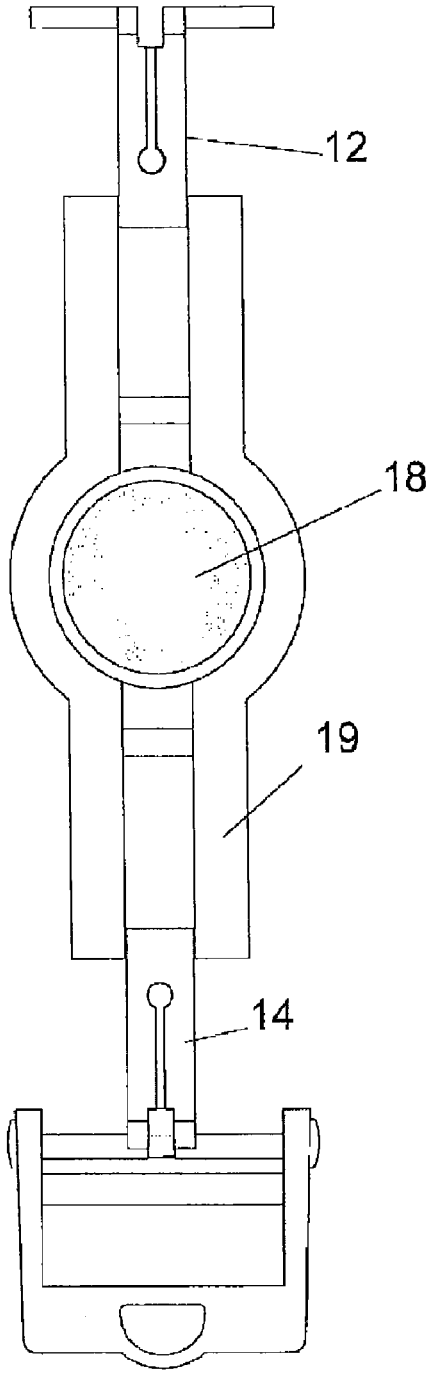
Figure 2A:
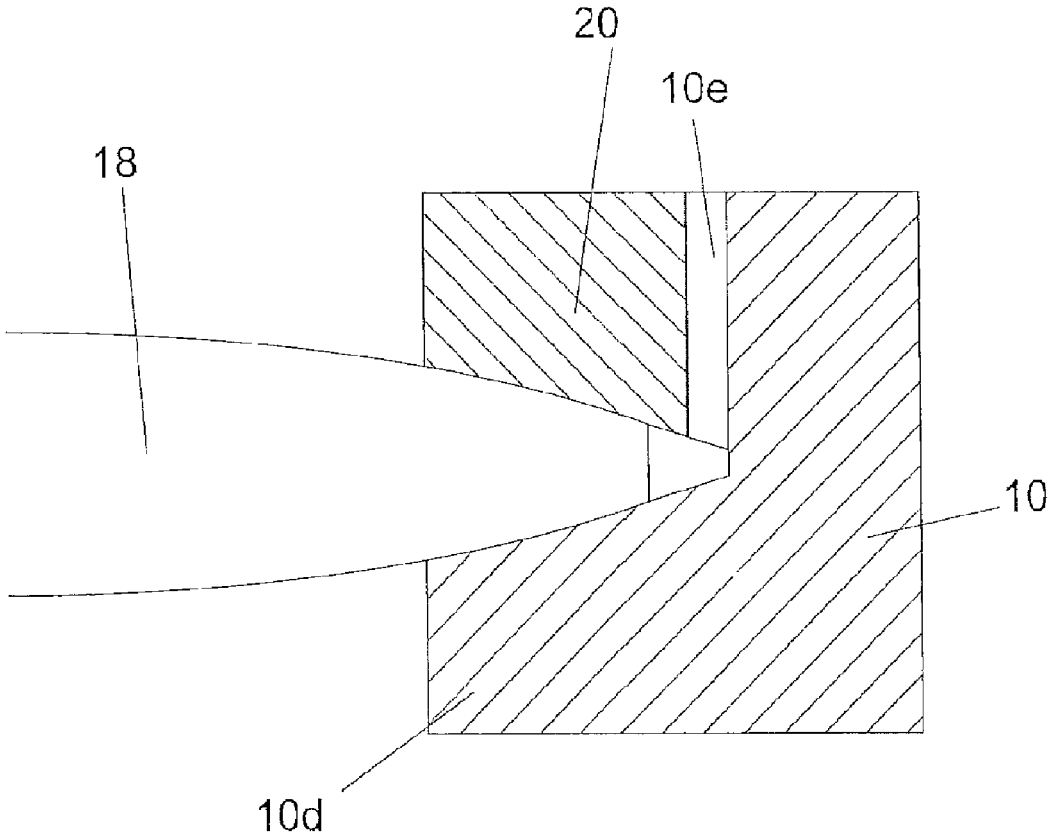

In the embodiment of FIG. 2, one finds the body 10 and the arms 12 and 14. In this embodiment, the arms 12 and 14 both have a turning-fork structure, which clips into the body 10. The latter is provided, in its median part, with a cylindrical opening in which the magnifying glass 18 is fixed. FIG. 2*a* shows, enlarged and in cross-section, the part of the body 10 supporting the magnifying glass 18. As shown by this figure, the body 10 has a shoulder 10*d* in the form of a truncated cone, on which the magnifying glass 18 rests. The wall of the body 10 is provided with a tapping 10*e* through which a ring 20 is screwed, which maintains the magnifying glass 18 in place. In this variation as well, the strand of the bracelet engaged in the buckle 16 covers the magnifying glass in the closed position of the bracelet, protecting it.

The magnifying glass 18 can be realized in any type of transparent material, but advantageously in sapphire, such that it does not scratch.

Figure 3:
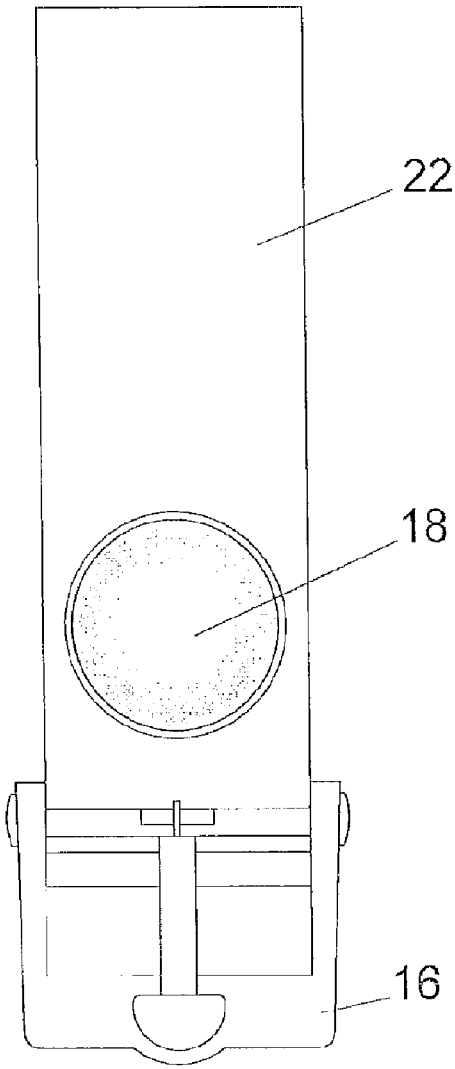

In the embodiment illustrated in FIG. 3, the bracelet comprises a strand 22 supporting the buckle 16. The strand 22 comprises, illustrated in FIG. 3*a*, a core formed of two sheets 22*a* and 22*b* in a semi-rigid material, welded to each other and provided with a cutout 22*c*. The magnifying glass 18, with a larger diameter than the cutout 22*c*, is housed there and maintained in place. The core is coated with two sheets of leather 22*d* and 22*e*, giving the bracelet an elegant appearance and providing comfort for the wearer. Also in this embodiment, the end of the second strand of the bracelet covers the magnifying glass 18.

Figure 4:
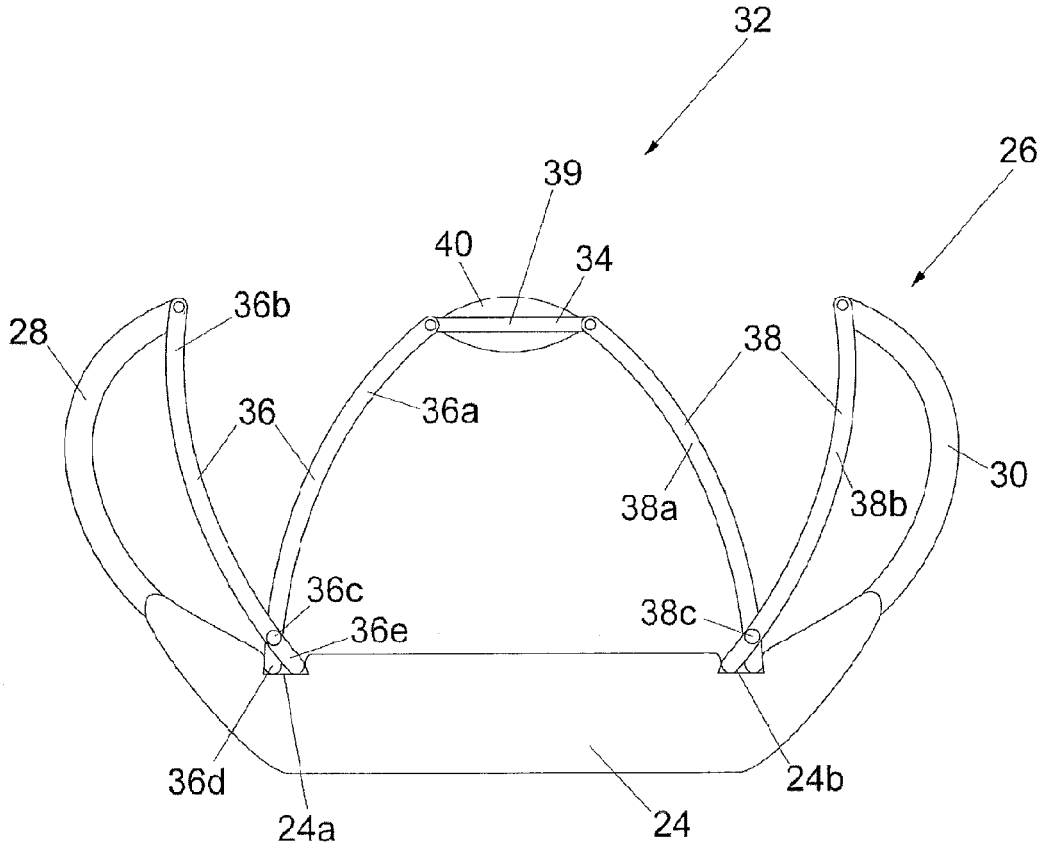
FIG. 4 illustrates an embodiment in which the magnifying glass is mounted with a certain rigidity on the case.

FIG. 4 shows, from the side, a watch comprising a case 24 and a bracelet 26, which comprises two strands 28 and 30 and a clasp 32. The latter part comprises a central body 34 and two pairs 36 and 38 of arms identified by the letters a and b, hinged in a bend identified by the letter c, forming an articulation. The pairs of arms are hingedly secured to the body 34 by one end and to the strands 28 and 30, respectively, by the other end.

The arms 36*a* and 36*b* of the pair 36 comprise, beyond their bend 36*c* forming the articulation, two fingers 36*d* and 36*e* which tend to separate from each other when the arms open. The structure is the same, symmetrically, regarding the arms 38*a* and 38*b*.

The case 24 comprises housings 24*a* and 24*b* in which the fingers 36*d* and 36*e*, 38*d* and 38*e*, respectively, are engaged. Once they are separated, they are kept in their respective housings 24*a* and 24*b*.

The central body 34 comprises a ring 39 inside which a magnifying glass 40 is mounted. The fastening of the magnifying glass 40 in the ring 39 can be done in different ways, for example by sticking or mechanically as explained in reference to FIG. 2.

One will note that in the case where the strands 28 and 30 are of the hinged link type, they tend, by their weight, to separate the two arms a and b of the pairs 36 and 38, thus maintaining them in the housing 24*a*. In this way, the magnifying glass 40 is positioned on the case 24, the bottom thereof being able to serve as a support to arrange an object to be examined there. It is, of course, also possible to admire the structure of the movement inasmuch as the bottom is transparent, or to read information etched on the bottom, for example an identification code.

The manner in which the arms 36 and 38 are engaged on the case 24 ensures satisfactory positioning. It is nevertheless possible to move the magnifying glass 40 laterally, by pressing on the arm 36*a* or 38*a*, such that the surface to be observed can thus be swept.

In this embodiment, the arm 36*b* could be extended so as to cover the magnifying glass 40 and thus form a protection member.

Figure 5A:
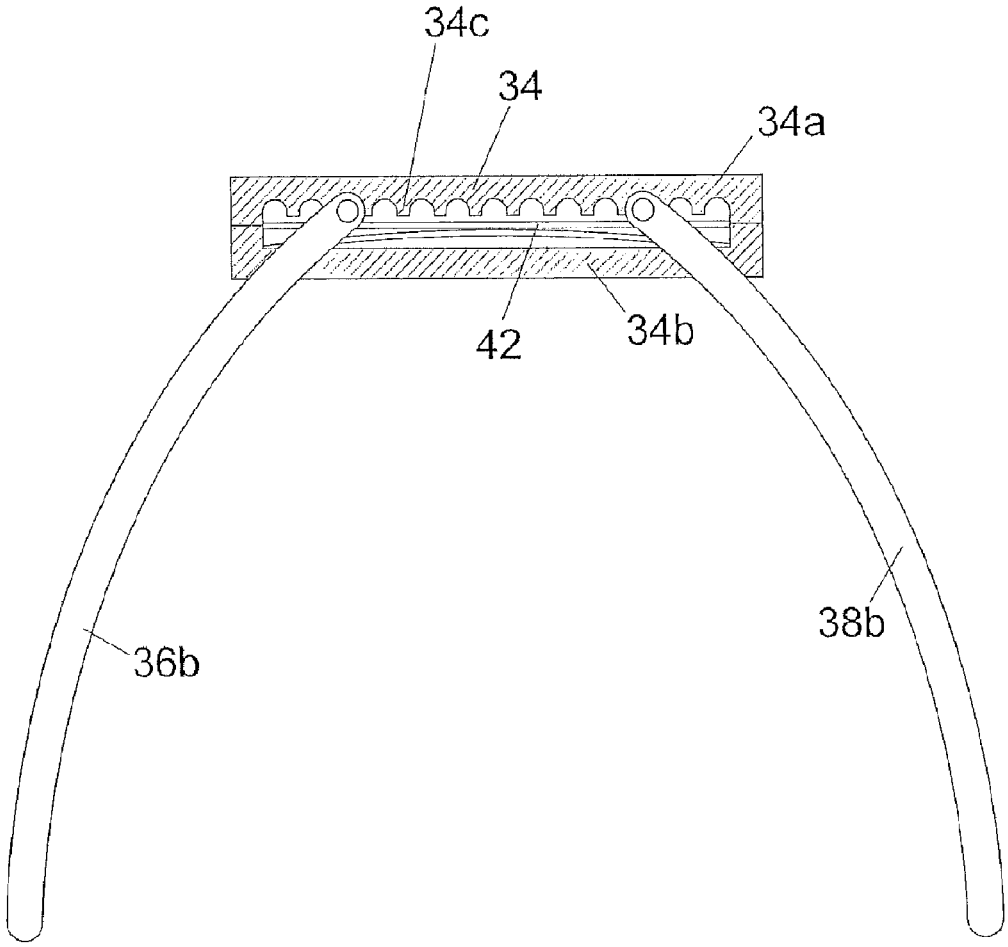
FIGS. 5*a* and 5*b* present a variation of the clasp equipping the watch of FIG. 4.
Figure 5B:
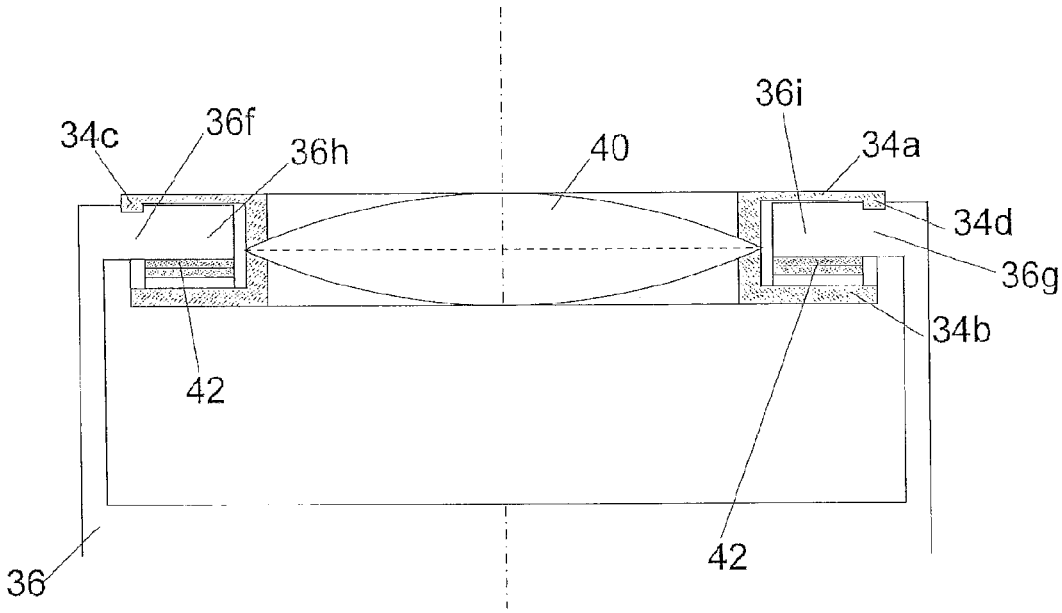

FIGS. 5*a* and 5*b* present a variation of the clasp equipping the watch of FIG. 4, in its part comprising the central body 34 and the arms 36*b* and 38*b*, seen from the side and in cross-section, respectively. In this variation, the central body 34 is formed of two shells 34*a* and 34*b* defining a housing between them whereof the side walls comprise rack structures 34*c* and 34*d*. A strip spring 42 is arranged in the housing. The arms 36 and 38 support, at their end near the body 34, two fingers bearing the references f and g, the free end of each of which is provided with a head bearing references h and i. The fingers f and g of a same arm are coaxial and arranged so as to cooperate respectively with the teeth of the racks 34*c* and 34*d*. The heads h and i are arranged inside the housing, bearing against the spring 42 which tends to push the fingers into the spaces between the teeth of the racks. In this way, the distance between the arms 36*a* and 38*a* can be adjusted. The more the ends of the arms 36*a* and 38*a* near the body 34 are close together, the closer the magnifying glass 40 is to the bottom. One will note that it is also thus possible to adjust the length of the bracelet very simply.

Figure 6:
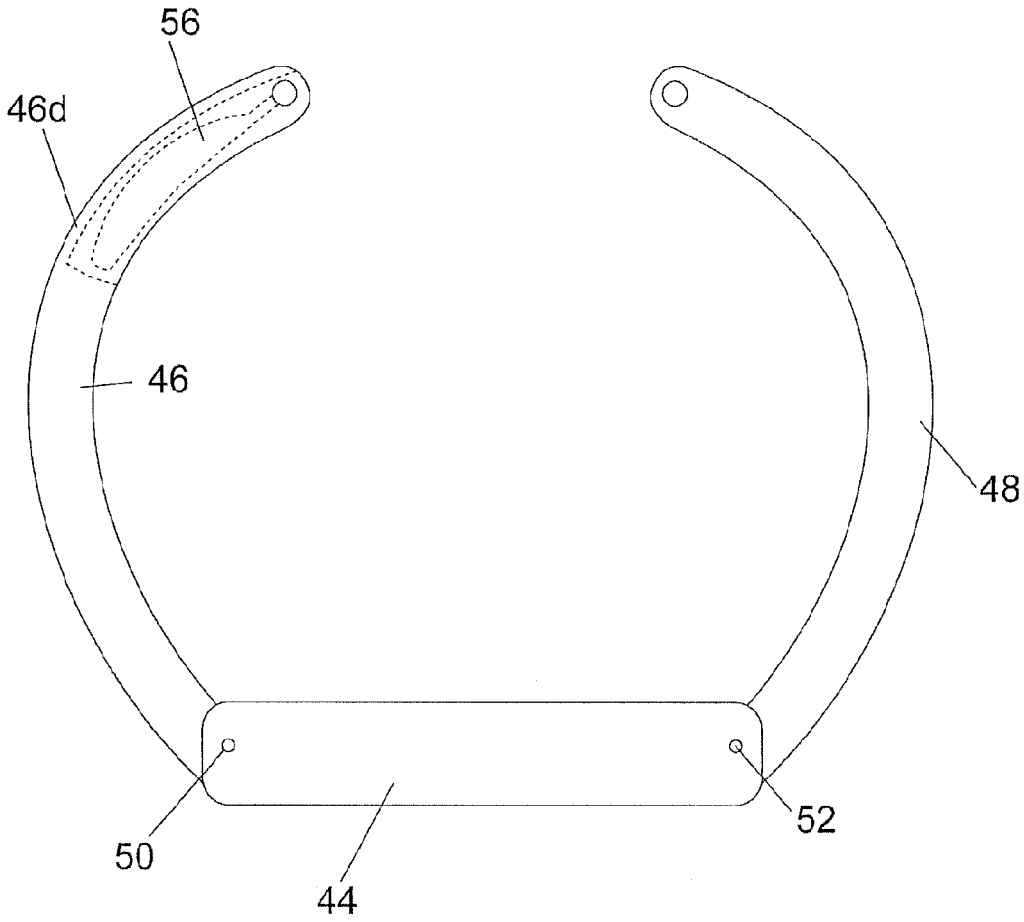
FIGS. 6 and 6*a* illustrate a marquise watch provided with a magnifying glass.
Figure 6A:
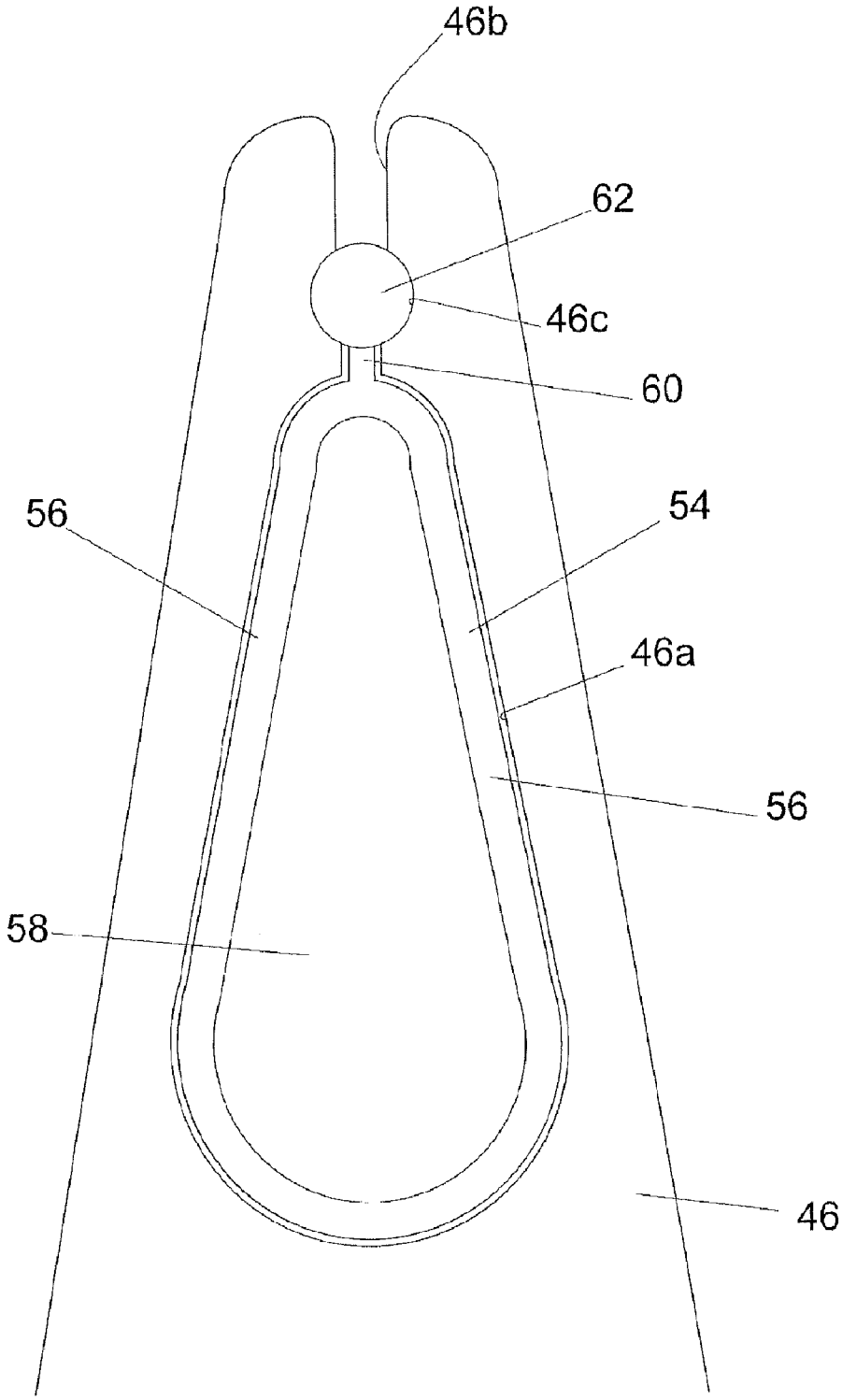

The watch illustrated in FIGS. 6 and 6*a* is of the marquise type. It comprises a case 44 and two rigid arms 46 and 48 mounted hingedly on the case 44, using spring hinges 50 and 52, tending to bring them closer to each other. As shown in FIG. 6*a*, which is an enlarged side view of the end of the arm 46, the latter is provided with an opening 46*a*, at its end opposite the hinge 50, in which is found a piece 54, of oblong shape. The piece 54 comprises a central portion 56 provided with a magnifying glass 58, a stem 60 at one of its ends, which is provided with a sphere 62. The opening 46*a* is adjacent to a slit 46*b* in which a housing 46*c* is formed receiving the sphere 62.

The opening 56*a* can be replaced by a housing whereof the bottom wall is situated on the convex side of the arm. In this way, when the magnifying glass 58 is retracted, it is protected by this wall.

The piece 54 can advantageously be held in the housing 46*a* by a ball housed in the strand 46 and cooperating with a recess formed in the framework of the central portion 56.

The portion 54 can be released from the arm 46 and brought into the interval between the two arms 46 and 48. In a variation which was not shown, the portion 54 can be pinched between the two arms, in order to be well-positioned. It is also possible to turn it practically in any position, thanks to a ball pivot connection ensured by the sphere 62 and the housing 46*c*.

The magnifying glass 58 is in a truncated lenticular shape, to fit the drop shape of the opening in which it is housed.

In this embodiment, the arm 48 could also be provided with a magnifying glass, such that the assembly thus formed constitutes a higher performance optic. By arranging the magnifying glass s such that they are oriented along an axis parallel to the bottom of the watch, it is also possible to realize a small long view, usable in the theater for example.

In order to protect the magnifying glass and avoid it becoming dirty, the bracelet can, furthermore, be equipped with a cover or a removable sleeve, removed during use.

Figure 7:
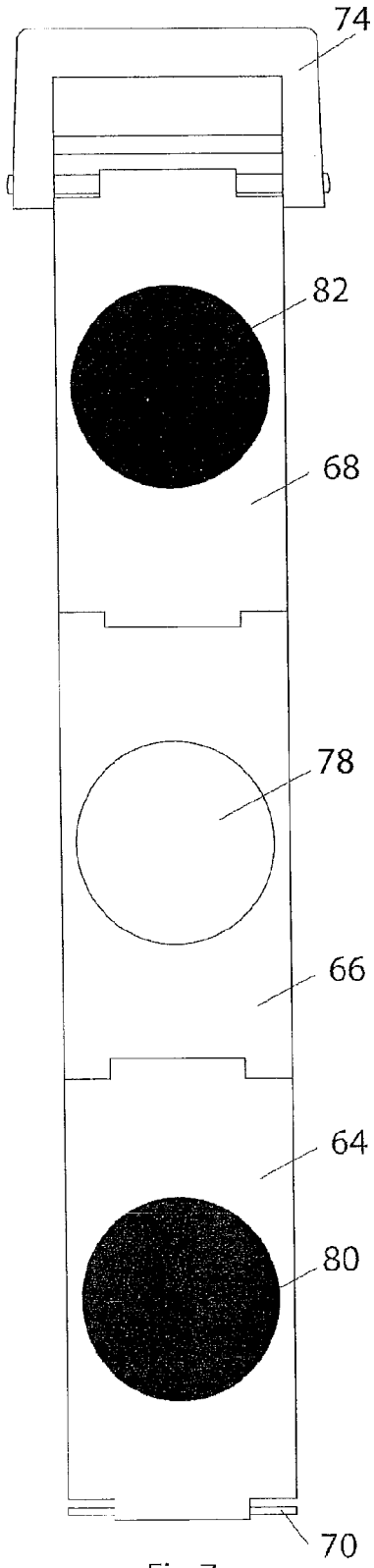
FIGS. 7 to 9 show a top view and side view, in the unfolded and folded positions, respectively, of another embodiment of a clasp according to the invention.
Figure 8:
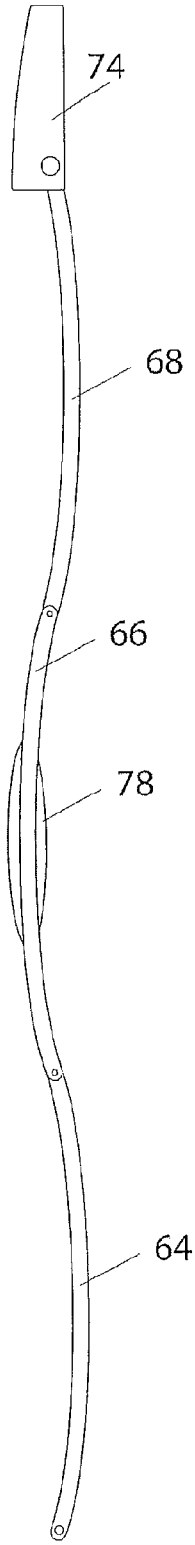
Figure 9:
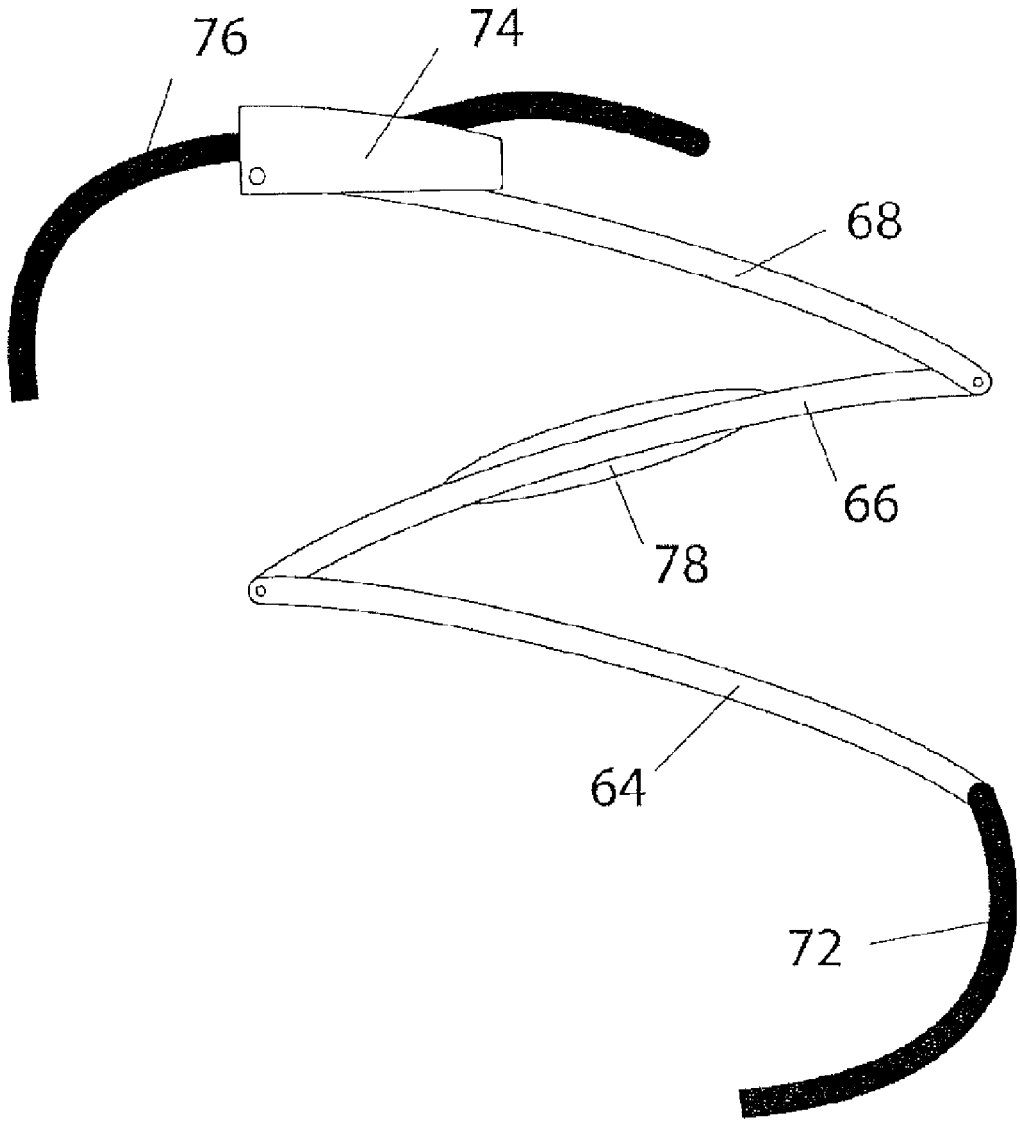

Another solution allowing good protection of the magnifying glass is shown in FIGS. 7 to 9. The clasp illustrated in these figures comprises three arms 64, 66 and 68 arranged in a chain and hinged to each other. These arms have shapes such that, when they are folded, they are substantially superimposed. The arm 64 is secured to a first strand 72 of the bracelet using a strip 70. The arm 68 is provided with a buckle 74 in which a second strand 76 of the bracelet is engaged. The buckle 74 is provided with a finger, not shown in the drawing, on which the second strand hooks through one of the holes with which it is provided. In this way, the length of the bracelet can be adjusted.

Figure 3A:
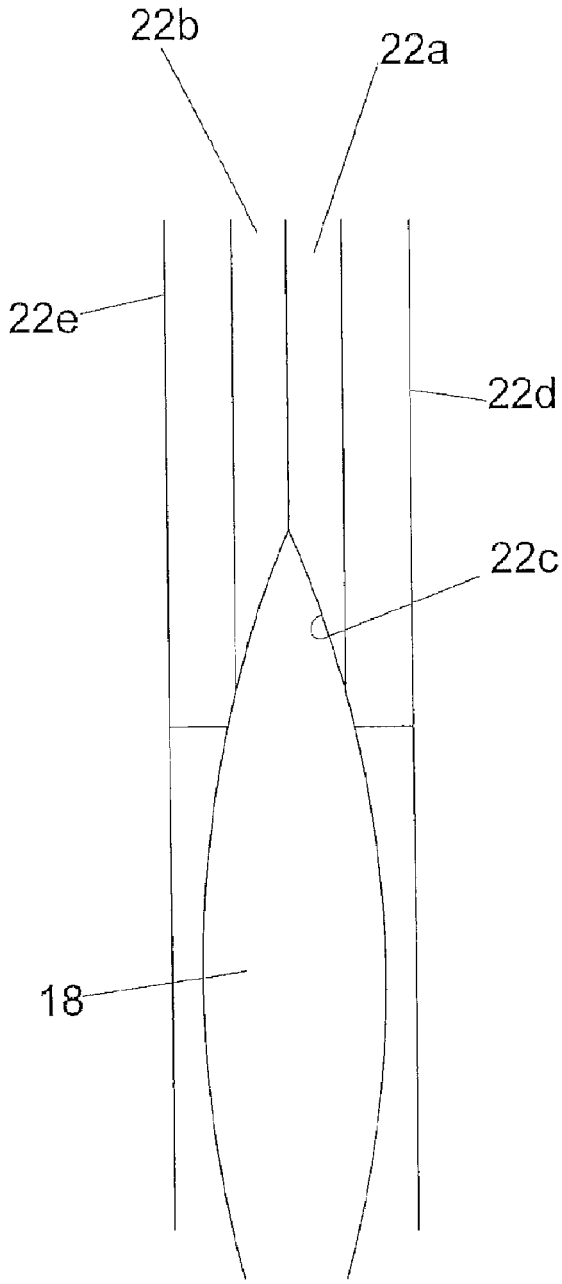

The median arm 66 supports a magnifying glass 78 of lenticular shape, which can be stuck or gripped there as shown in FIG. 3*a*. Moreover, the arms 64 and 68 comprise, in their median portion, membranes 80 and 82, made in leather for example. These membranes are arranged such that they cover the magnifying glass 78 when the arms are folded, i.e. in the position which they occupy when the clasp is closed, and therefore when the watch is worn. In this way, the magnifying glass is completely protected.

The watch bracelets which have been described can be the object of many other variations without going beyond the scope of the invention. Thus, the solutions shown in FIGS. 1 to 4 could also be applied to a bracelet whereof the clasp only comprises one pair of deploying arms.

Other means can also be used to position the magnifying glass in reference to the case. These means can be directly connected to the bracelet. They can also be formed by a mobile piece integral with the case.

Rather than being secured using a ring, the magnifying glass could also have shapes such that it comprises its own fastening means.

In any case, a watch equipped with a bracelet of this type allows its user a complement enabling him to improve his observation conditions, close up or far away, under at least certain conditions.

The invention claimed is:

1. A watch bracelet comprising two strands designed to be secured each by one of its ends to a watch case, a clasp, attached to the strands by the other end and being able to occupy an open position and a closed position, and a magnifying glass of lenticular shape, wherein said clasp comprises a body and at least two arms articulated to each other in a bend, said arms being hingedly secured to said body by one end and to one of the strands by the other end, and wherein said magnifying glass is mounted in said body.

2. The bracelet according to claim 1, wherein it furthermore comprises a protection organ arranged so as to cover said magnifying glass when the clasp occupies its closed position.

3. The bracelet according to claim 2, wherein one of the arms articulated to one of the strands is extended so as to cover the magnifying glass in order to form said protection organ.

4. The bracelet according to claim 1, wherein said arms comprise, beyond their bend, two fingers.

5. The bracelet according to claim 3, wherein said arms comprise, beyond their bend, two fingers.

6. The bracelet according to claim 1, wherein said magnifying glass is in sapphire.

7. A watch provided with a bracelet comprising two strands designed to be secured each by one of its ends to a watch case, a clasp, attached to the strands by the other end and being able to occupy an open position and a closed position, and a magnifying glass of lenticular shape, said clasp comprising a body and at least two arms articulated to each other in a bend, said arms being hingedly secured to said body by one end and to one of the strands by the other end, and said magnifying glass being mounted in said body, wherein said watch also comprises a case, in which the case and the clasp comprise male organs for one, female organs for the other arranged in order to be engaged in each other, arranged to position the magnifying glass.

* * * * *